US005894871A

United States Patent [19]

Greer

[11] Patent Number: 5,894,871

[45] Date of Patent: Apr. 20, 1999

[54] SAND HOPPER FOR FILLING BAGS

[76] Inventor: David L. Greer, 2511 Metairie Lawn Dr., Apt. 201, Metairie, La. 70002

[21] Appl. No.: 08/917,544

[22] Filed: Aug. 26, 1997

[51] Int. Cl.[6] ..... B65B 1/04

[52] U.S. Cl. ..... 141/231; 141/102; 141/114; 141/256; 141/313

[58] Field of Search ..... 141/1, 10, 100, 141/102, 114, 231, 256, 313; 414/354

[56] References Cited

U.S. PATENT DOCUMENTS

| | | | |
|---|---|---|---|
| 1,753,716 | 4/1930 | Owen . | |
| 3,469,824 | 9/1969 | Futty et al. . | |
| 4,184,522 | 1/1980 | Waite | 141/231 |
| 4,223,996 | 9/1980 | Mathis et al. . | |
| 4,484,606 | 11/1984 | Kosters | 141/256 |
| 4,763,702 | 8/1988 | High, Jr. et al. | 141/231 |
| 5,121,775 | 6/1992 | McClain | 141/231 |
| 5,215,127 | 6/1993 | Bergeron . | |
| 5,417,261 | 5/1995 | Kanzier et al. . | |
| 5,425,403 | 6/1995 | Herrmann | 141/256 |
| 5,437,318 | 8/1995 | Kanzler et al. | 141/256 |
| 5,564,886 | 10/1996 | Emerson et al. . | |
| 5,573,044 | 11/1996 | Mechalas . | |

*Primary Examiner*—David J. Walczak
*Assistant Examiner*—Timothy L. Maust
*Attorney, Agent, or Firm*—Terrance L. Siemens

[57] ABSTRACT

A mobile dispensing apparatus capable of onsite bagging of fluent solid materials such as sand. The apparatus includes a hopper supported on wheels and having a trailer hitch. Three augers convey fluent material to three chutes. Each chute has a clamp for supporting a bag being filled. The apparatus has an on-board engine and a transmission selectively driving each auger. A pedal at each chute operates its respective clamp and connects its respective auger to the transmission by an electric clutch. The hopper has side doors and rear doors. A ramp can be removably attached at the rear door of the hopper. An open grate forms a floor within the hopper. Shelves are disposed within the hopper.

8 Claims, 4 Drawing Sheets

SAND HOPPER FOR FILLING BAGS

CROSS REFERENCE TO RELATED DISCLOSURE DOCUMENT

This invention was disclosed in Information Disclosure Document No. 388131, filed with the United States Patent and Trademark Office on Sep. 1, 1995.

BACKGROUND OF THE INVENTION

1. Field of the Invention

The present invention relates to equipment for dispensing bulk fluent solid material into containers. The equipment includes a receptacle for receiving fluent material and three powered augers arranged to dispense the fluent material through three respective chutes. A bag or the like may be suspended from each chute while filling. The novel equipment is mobile, and thus is particularly suited for bagging crops, seed, and fertilizer in agricultural settings, salt or grit for distribution on icy road surfaces, sand for flood control and temporary fortifications such as bunkers, and bulk packaging of toxic or environmentally objectionable materials for disposal.

2. Description of the Prior Art

From time to time, it is necessary or desirable to bag bulk fluent solid materials at a selected site which is not provided with permanently fixed bagging equipment. Examples are sites requiring sand bags, such as flooded areas and sites of military activity requiring protected bunkers or other structures. In other instances, farmers may be required to bag bulk seeds, crops, or fertilizer for transport. Appearance of ice on road surfaces may require localized distribution of salt or gritty substances stored at a distance from the point of need. Contaminated soils may be discovered which must be transported to a disposal facility or site.

In these cases, the need for bagging equipment is not necessarily forseeable or sufficiently predictable for it to be feasible to provide such equipment before the need is realized. Mobile, highly productive equipment is required for transporting to the point of need apparatus for rapidly and continuously bagging granular or otherwise fluent solid and semi-solid materials.

U.S. Pat. No. 5,215,127, issued to Guy E. Bergeron on Jun. 1, 1993, shows a bag filling device comprising a feed conveyor discharging selectively into any one of plural chutes. This device lacks the augers of the present invention, having a single open conveyor instead. This conveyor feeds only one chute. By contrast, the present invention can fill several bags simultaneously. Bergeron lacks the bag retaining clamps of the present invention.

U.S. Pat. No. 5,417,261, issued to Estacia R. Kanzler et al. on May 23, 1995, describes a hopper having plural chutes for filling bags. This device operates by gravity, lacking the motorized plural augers of the present invention. Also, this device is not wheeled, as is the novel equipment. Each chute of the device of Kanzler et al. has a foot pedal operated closure. In the present invention, foot pedal controls perform other functions.

U.S. Pat. No. 5,564,886, issued to Earl W. Emerson et al. on Oct. 15, 1996, describes an auger adapted for mounting in the bucket or shovel of loading equipment. This device has a single auger arranged to discharge through plural spouts or chutes. The present invention has, by contrast, plural, independently controlled augers mounted below a storage hopper. The present invention also has clamps for retaining bags mounted on the chutes.

A bag filling apparatus shown in U.S. Pat. No. 5,573,044, issued to Emmanuel Mechalas on Nov. 12, 1996, operates by vacuum. This device lacks the plural, independently controlled augers and bag clamping apparatus of the present invention.

Mixers share some structure with the present invention. An example is seen in U.S. Pat. No. 4,223,996, issued to Paul Mathis et al. on Sep. 23, 1980, which describes a motorized auger which discharges a fluent solid from one end of the auger. This invention illustrates a single motorized auger, rather than the selectively operated plural, commonly fed augers of the present invention. Mathis also lacks bag retaining clamps provided in the present invention.

A need remains for a dispensing apparatus which supports and fills a variable number of bags at any one time.

None of the above inventions and patents, taken either singly or in combination, is seen to describe the instant invention as claimed.

SUMMARY OF THE INVENTION

The present invention provides powered dispensing equipment for discharging fluent solid material such as sand and similar granular materials into receptacles. Although it is contemplated that bagging sand will be the principal application of the invention, other materials may be handled. Illustratively, the material dispensed by the novel apparatus can be chaff from threshing operations, feathers, fibrous insulation material, low density packing material, fiber scrap from textile manufacturing processes, and still others. The apparatus has wheels and structure for attachment to a tow vehicle, so that it is mobile. The apparatus includes a storage hopper for receiving and dispensing the fluent solid being dispensed. Three augers feed the material into discharge chutes for filling three bags simultaneously. The chutes have bag retaining devices so that bags can be suspended and filled without requiring a person to hold the bag. The apparatus has an internal combustion engine so that it can operate independently of connection to external power. Each auger is controlled independently of the others, although they have a common power source in the internal combustion engine.

An advantage of the invention is that since it is mobile and self-contained, it can be transported to areas of transient need, then removed. The site of operation need not be structured, in that no loading dock, finished concrete surface, enclosed shelter, or electrical power need be present. The invention is suitable for operation at flood sites, on farms, on undeveloped tracts of land, and the like. In some cases, the invention may be employed to package natural minerals occurring in quantities not great enough to justify building permanent extraction facilities.

The hopper has side mounted doors to enable loading by mechanized equipment, such as small earth moving type equipment. The body of the hopper is adapted to carry cargo, so that the novel apparatus serves as a trailer during transport. Additional doors at the rear and at the bottom of the hopper are optionally provided for still improved access to the interior of the hopper. The hopper is optionally fitted with ramps to enable large equipment transported therein to be readily removed for use.

Accordingly, it is a principal object of the invention to provide apparatus for automatically filling bags with fluent solid material.

It is another object of the invention to fill a plurality of bags simultaneously.

It is a further object of the invention to provide mobile, self-contained bagging equipment.

Still another object of the invention is to enable the interior of the bagging equipment to be utilized as storage space in transport.

An additional object of the invention is to support bags during filling without requiring constant human attention.

It is again an object of the invention that a plurality of discharge chutes be provided.

Yet another object of the invention is that individual discharge chutes be operable independently of the other chutes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
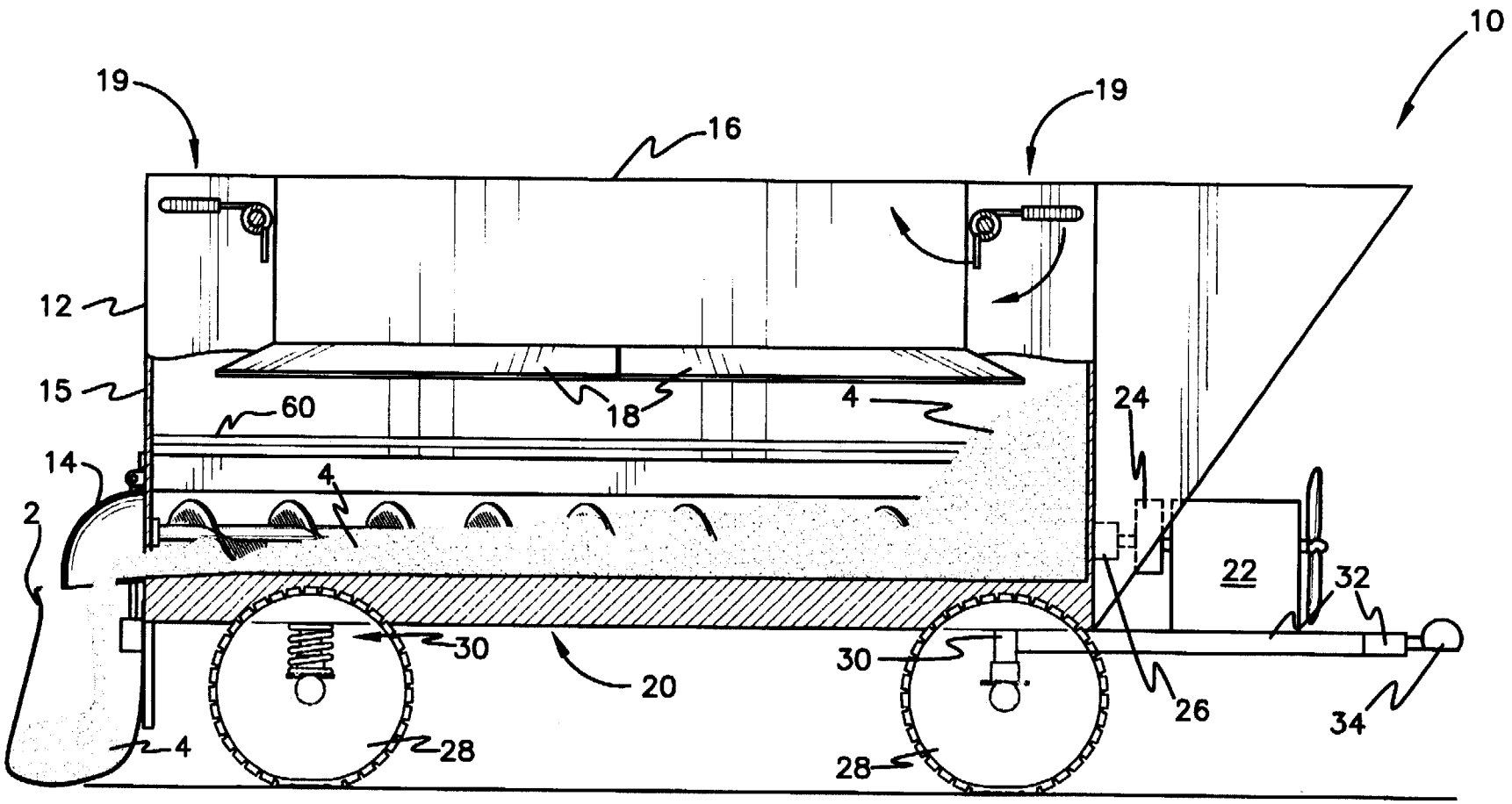
FIG. 1 is a diagrammatic, environmental, side cross sectional view of the invention.

FIG. 1 of the drawings shows an apparatus 10 for dispensing fluent solid material 4 into receptacles such as bag 2. Of course, the type of receptacle is not important, and may include drums, boxes, open troughs, and others. Apparatus 10 includes a storage hopper 12 having a plurality of chutes 14 disposed in communication with hopper 12. The fluent material 4 is stored in hopper 12 and discharged through chutes 14 into the receptacle. Storage hopper 12 includes an unbroken bottom wall 13 and the chutes 14 are all located on the rear wall 15 of storage hopper 12.

Hopper 12 may have a roof 16 or other cover to protect contents. Illustratively, salt, which is commonly employed to melt ice on roadways in cold climates, would fuse into a solid mass if subjected to rain. An openable closure such as doors 18 provided on a lateral side of hopper 12 are provided if roof 16 is not hinged or otherwise rendered openable. The closure enables loading hopper 12 from a conveyor (not shown), mobile earth moving equipment (not shown), or any other equipment suitable for discharging the fluent material 4 into hopper 12. Doors 18 are secured in place in any suitable way, such as by retaining device 19. Device 19 comprises a handle for grasping and maneuvering, and a finger which is rotated into a position obstructing downward swing of door 18. Device 10 is rotatably fastened to a wall of hopper 12.

Fluent material 4 is transported to each chute 14 from the interior storage chamber of hopper 12 by a suitable conveyor. A preferred form of conveyor is screw auger 20. Augers 20 are rotated by a power plant, such as diesel engine 22. Although shown only diagrammatically, engine 22 will be understood to include all components conventionally furnished with engines for supporting all necessary functions enabling the engine to be self-contained and to operate independently of external connections and components. Illustratively, such components include battery, AC or DC generator, fuel tank and conduits, exhaust system, radiator and associated conduits, starting motor, and the like.

Output of engine 22 is distributed by a suitable transmission 24 to each individual rotatable power shaft of each auger 20. Transmission 24 may comprise an arrangement of chains, belts, rods, gears, and shafts (none shown) necessary to accomplish distribution of rotary output of engine 22. Transmission 24 encompasses any suitable mechanical, hydraulic, pneumatic, or electrical device transmitting rotary motion from engine 22 to each chute 14. Although rotational speed may, if desired, be increased or decreased over that of the output of engine 22, this characteristic is not necessarily accomplished in transmission 24. Each power shaft of each auger 20 is controlled by a suitable clutch 26 which selectively drives its associated shaft from transmission 24 and isolates the shaft from transmission 24. Each clutch 26 is of any suitable type, such as electrical or mechanically operated friction type. Each clutch 26 is operated by a pedal 50 (see FIG. 3) accessible to an operator filling a bag 2. Each pedal 50 is associated with a controller 36 (see FIG. 2) for controlling each auger 20 independently of other augers 20.

Because apparatus 10 is mobile, it includes wheels 28 suitably connected to apparatus 10 by a suitable suspension 30. Apparatus 10 will be understood to include a frame or chassis (not separately shown), if construction of hopper 12 is not sufficiently stout to provide an equivalent function. Wheels 28 and suspension 30 may be provided with springs, pivotal components, and the like for supporting hopper 12 above the ground, providing steering and turning functions and to comply with irregular surfaces. Apparatus 10 may be provided with brakes (not shown), if desired.

Apparatus 10 also has an arm 32 projecting horizontally and forwardly from apparatus 10. Arm 30 terminates in a trailer hitch 34 mounted thereon, so that apparatus 10 is readily towed by a tow vehicle (not shown). Arm 32 may assume the configuration of a so-called gooseneck (not shown), being curved so as to approach the connection of the tow vehicle from above, rather than extending horizontally as depicted. Also, it will be appreciated that trailer hitch 34 is shown only in a representative capacity, and may be replaced by other types of releasable connectors for connection to a tow vehicle.

Figure 2:
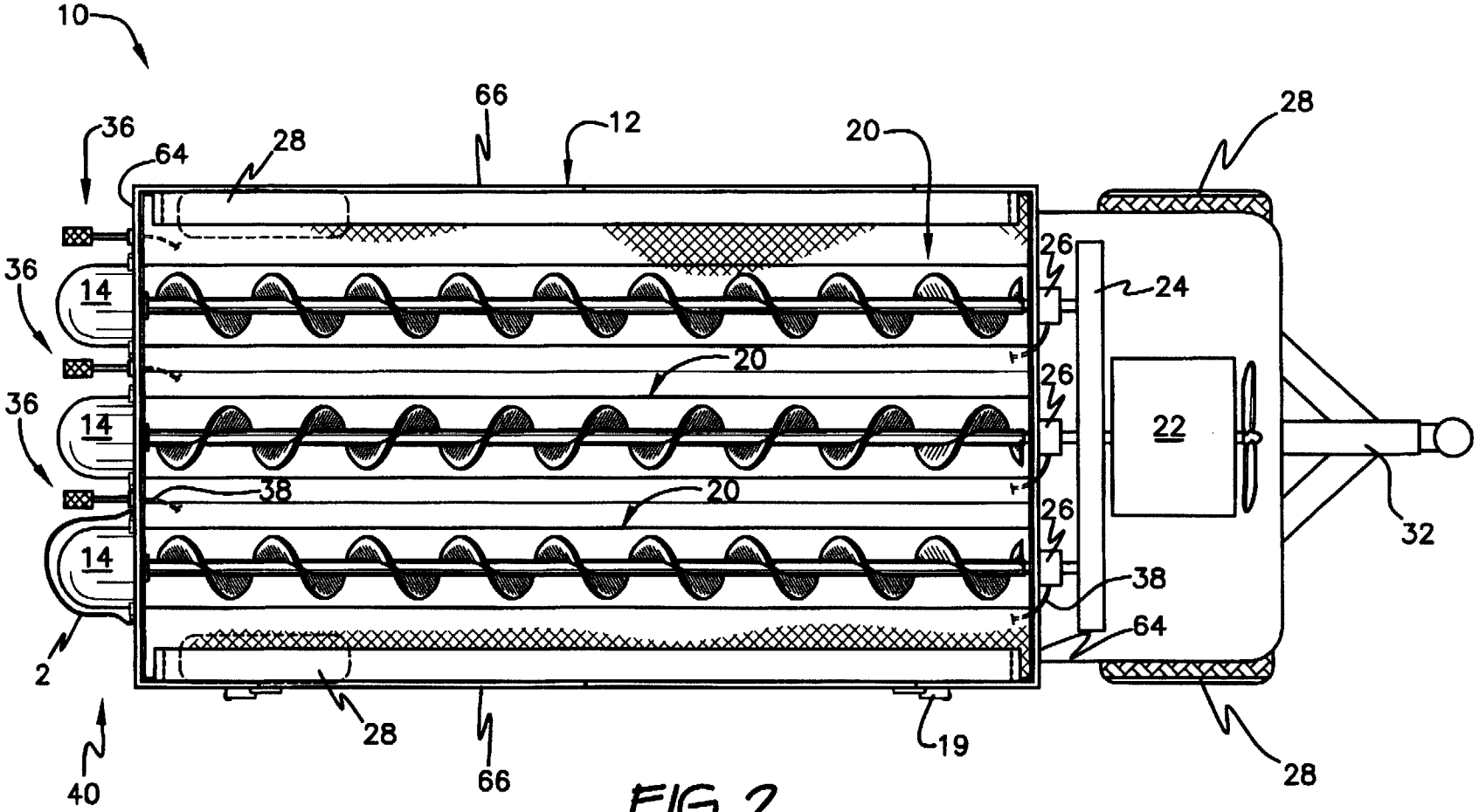
FIG. 2 is a diagrammatic, environmental top plan view of the invention.

FIG. 2 clearly reveals the arrangement of augers 20, which are arranged abreast and disposed to discharge at the rear of apparatus 10. Each auger 20 has a foot pedal control mechanism 36 located proximate its respective chute 14, which control mechanism 36 at a minimum operates its respective clutch 26 by a suitable control connection represented by electrical conductor 38. However, control mechanism 36 preferably also controls a clamp indicated generally at 40 in FIG. 2.

Figure 3:
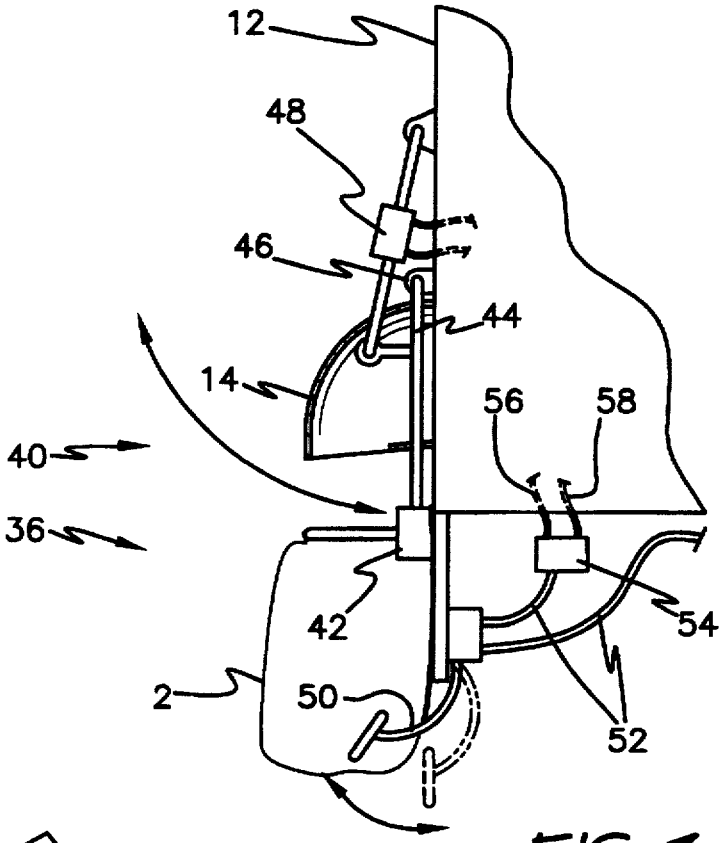
FIG. 3 is a side elevational detail view taken from the left side of FIG. 1.

Better shown in FIG. 3, clamp 40 is arranged to support a bag 2 below associated chute 14. Clamp 40 comprises a contact block 42 which pins bag 2 against the rear wall of hopper 12. Contact block 42 is supported on an arm 44 pivotally supported on the rear wall of hopper 12 by a suitable journalling or trunnion fitting 46. A hydraulic cylinder assembly 48 is arranged to pivot arm 44 and thus contact block 42 into and away from the clamping position illustrated in FIG. 3. Cylinder assembly 48 may be controlled by pedal 50 of control mechanism 36 in any suitable way. In one example, control mechanism 36 includes a switch (not separately shown) which makes a circuit represented by conductor 52 supplying electrical power to a hydraulic pump 54. Hydraulic fluid is supplied under pressure to cylinder assembly 48 and returned to pump 54 by conduits 56, 58. Of course, clamp 40 may be electrically, pneumatically, or manually operated, if desired.

Figure 4:
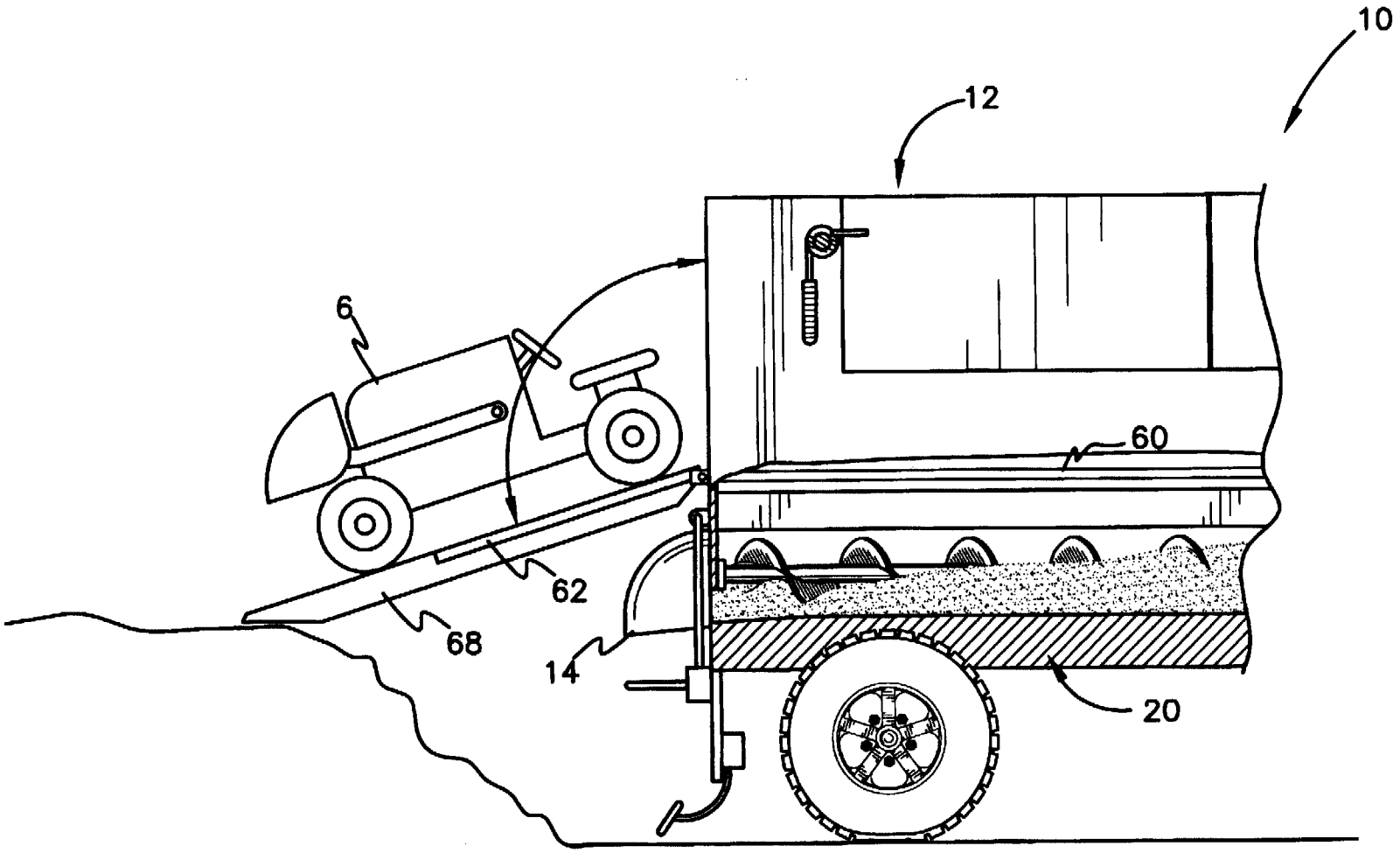
FIG. 4 is an environmental side elevational detail view of the invention, depicting an alternative embodiment of the invention including a ramp attached to the apparatus and cargo being unloaded by the ramp.

FIG. 4 illustrates an optional feature of apparatus 10. The storage chamber existing inside hopper 12 may be utilized as storage space when apparatus 10 is in transit. The storage chamber of hopper 12 is provided with a perforated metal grate 60 which serves as a floor enabling the storage chamber to contain cargo. Grate 60 has openings enabling passage of fluent material 2 to augers 20 disposed below grate 60. However, grate 60 will support large objects, such as small motorized earth moving equipment 6, tools (not shown), and the like to be stored within hopper 12 when fluent material is not present. A full height door 62, preferably located on an end wall 64 (see FIG. 2) of hopper 12, swings down to reveal the storage chamber. End wall 64 is either the front or rear wall of hopper 12, as contrasted with a lateral wall 66 (see FIG. 2). Of course, doors 18 (see FIG. 1) could be full height to accomplish a similar purpose, if desired. However, it is contemplated that objects such as equipment 6 will be of such a length that it will prove more feasible to align the respective longitudinal dimensions of apparatus 10 and equipment 6 to be parallel.

Figure 5:
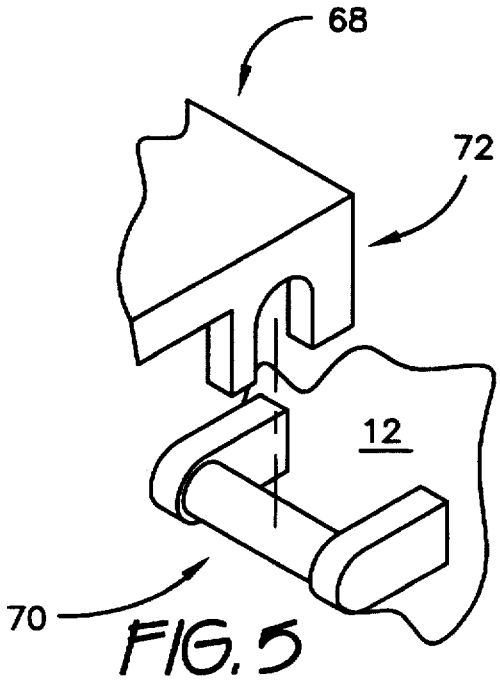
FIG. 5 is a perspective detail view showing apparatus for enabling the ramp of FIG. 4 to engage the invention.

Door 62 is supported on, or alternatively, replaced by, a ramp 68. Ramp 68 engages hopper 12 by a finger and socket arrangement shown in FIG. 5. The socket is formed by a member 70 which is solidly fixed to the rear wall of hopper 12 or to the frame (not shown) of apparatus 10. Member 70 receives a cooperating member 72 fixed to ramp 68. Regardless of their precise configurations and natures, members 70 and 72 interlock to enable ramp 68 to be secured to apparatus 10.

Figure 6:
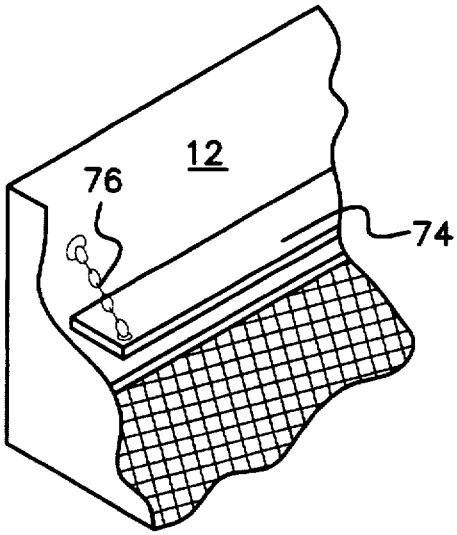
FIG. 6 is a perspective detail view of the interior of the hopper, illustrating further aspects of the embodiment of FIG. 4.

Additional accommodation for cargo and human riders may be provided in the embodiment of FIG. 4. As shown in FIG. 6, a shelf 74 may be attached to a wall of hopper 12. Shelf 74 is preferably of the fold up or fold down type, having a chain 76 supporting shelf 74 horizontally. Shelf 74 may support personnel, if desired.

The present invention is susceptible to variations and modifications which may be introduced without departing from the inventive concept. For example, the conveyor is preferably a screw auger, but may be a continuous or segmented endless belt, a fan or similar pneumatic driver, a movable magnet, or any other device suitable for transporting the fluent material to a chute from the storage chamber of hopper.

The various doors may be arranged as desired, at any location and height with respect to the height of hopper 12, and in any number.

Augers 20 may be arranged at any desired orientation within hopper 12, such as extending from one lateral side to the other, instead of front to rear. They may also depart from their orientation in the horizontal plane, as illustrated.

It is to be understood that the present invention is not limited to the embodiments described above, but encompasses any and all embodiments within the scope of the following claims.

I claim:

1. Apparatus for dispensing fluent solid material into receptacles, comprising:

a storage hopper having sides and an unbroken bottom wall;

a power plant;

a plurality of horizontally disposed screw augers contained within said storage hopper proximate said unbroken bottom wall, said horizontally disposed screw augers being powered by said power plant, each of said horizontally disposed screw augers being connected to said power plant by transmission means;

a plurality of orifices, located on one of said sides of said storage hopper, each of said orifices being associated with one of said plurality of horizontally disposed screw augers such that when one of said screw augers is activated and turned, the fluent solid material is extruded through said associated orifice;

means for maintaining a bag in a fixed relationship relative to each of said orifices such that the fluent solid material is extruded through said orifice and into the bag when said associated screw auger is activated and turned; wheels attached to said storage hopper to support said hopper above the ground; an arm projecting horizontally from said apparatus; and a trailer hitch attached to said arm to allow for said apparatus to be readily towed by a vehicle.

2. The apparatus according to claim 1, further including a control means associated with each of said horizontally disposed screw augers, said control means located proximate each said orifice associated with each said horizontally oriented screw auger.

3. The apparatus according to claim 2 where said control means associated with each of said horizontally disposed screw augers and said associated orifices comprises a foot pedal connected to said transmission means.

4. The apparatus according to claim 1, further including an openable closure located on a lateral side of said storage hopper and including a fastener to hold said openable closure in a closed position.

5. The apparatus according to claim 1, further including a grate adapted to hold the weight of a small earthmoving vehicle and a plurality of people, said grate being disposed within said storage hopper above said plurality of horizontally disposed screw augers, said grate also being dimensioned to easily pass the fluent solid material whereby the vehicle and people may be transported in said storage hopper during transit.

6. The apparatus according to claim 5, further including a door located on one end of said storage hopper and a ramp engageable with said door, said ramp being formed separately from said door and engageable therewith such that the small earthmoving vehicle may enter or exit said storage hopper.

7. Apparatus for dispensing fluent solid material into receptacles, comprising:

a storage hopper having an opening for loading, a lateral side and an end side, a first openable closure located on a lateral side of said hopper, said hopper having a fastening element disposed to retain said first openable closure in a closed position, a second closure disposed upon one said end side, whereby objects carried within said hopper during transit may be unloaded from said end side and said hopper may be loaded with fluent material selectively from said end side and from a said lateral side, a grate disposed above said augers, whereby objects may be transported in said hopper during transit, and at least one shelf disposed inside said hopper and fixed thereto, whereby objects may be supported within said hopper during transit;

a plurality of chutes communicating with said hopper;

a plurality of screw augers each disposed to transport fluent material from said hopper to one said chute;

an internal combustion engine carried aboard said apparatus, and a transmission operably connecting said power plant to said augers; and control means for controlling each one said auger independently of every other said auger, said control means comprising an electrically operated clutch for each one said auger and one foot pedal for each one said auger, said foot pedal operably connected to said transmission and arranged selectively to drive and isolate its respective said auger from said transmission, each said foot pedal being located proximate its respective said chute, said apparatus having wheels fixed to said apparatus and arranged to support said hopper above the ground, an arm projecting horizontally from said apparatus, and a trailer hitch mounted on said arm, whereby said apparatus is readily towed by a tow vehicle, each said auger having a clamp disposed to support a bag below its respective said chute.

8. Apparatus for dispensing fluent solid material into receptacles, comprising:

a storage hopper having sides and an unbroken bottom wall;

a power plant;

a plurality of horizontally disposed screw augers contained within said storage hopper proximate said unbroken bottom wall, said horizontally disposed screw augers being powered by said power plant, each of said horizontally disposed screw augers being connected to said power plant by transmission means;

a plurality of orifices, located on one of said sides of said storage hopper, each of said orifices being associated with one of said plurality of horizontally disposed screw augers such that when one of said screw augers is activated and turned, the fluent solid material is extruded through said associated orifice;

means for maintaining a bag in a fixed relationship relative to each of said orifices such that the fluent solid material is extruded through said orifice and into the bag when said associated screw auger is activated and turned;

a first closure located on a lateral wall of said storage hopper, said first closure including a retaining means for retaining said first closure in a closed position; and a second closure located on an end wall of said storage hopper, said second closure including a retaining means for retaining said second closure in a closed position, said second closure adapted to allow objects carried within said storage hopper during transit to be unloaded and where said first and said second closure may be used to load said storage hopper with fluent material.

* * * * *

UNITED STATES PATENT AND TRADEMARK OFFICE

CERTIFICATE OF CORRECTION

PATENT NO. : 5,894,871

DATED : April 20, 1999

INVENTOR(S) : David L. Greer

It is certified that error appears in the above-identified patent and that said Letters Patent is hereby corrected as shown below:

Title page, item [76], inventor's address should be "37 Walton Circle, Paris, Tennessee 38242".

Signed and Sealed this

Twenty-fourth Day of August, 1999

*Attest:*

*Attesting Officer*

Q. TODD DICKINSON

*Acting Commissioner of Patents and Trademarks*